US011627851B2

(12) United States Patent
Ohlendorf

(10) Patent No.: US 11,627,851 B2
(45) Date of Patent: Apr. 18, 2023

(54) SEPARATING DEVICE FOR A VACUUMING DEVICE

(71) Applicant: Hilti Aktiengesellschaft, Schaan (LI)

(72) Inventor: Oliver Ohlendorf, Landsberg (DE)

(73) Assignee: Hilti Aktiengesellschaft, Schaan (LI)

( * ) Notice: Subject to any disclaimer, the term of this patent is extended or adjusted under 35 U.S.C. 154(b) by 212 days.

(21) Appl. No.: 17/044,526

(22) PCT Filed: Apr. 2, 2019

(86) PCT No.: PCT/EP2019/058233
§ 371 (c)(1),
(2) Date: Oct. 1, 2020

(87) PCT Pub. No.: WO2019/197206
PCT Pub. Date: Oct. 17, 2019

(65) Prior Publication Data

US 2021/0161343 A1 Jun. 3, 2021

(30) Foreign Application Priority Data

Apr. 9, 2018 (EP) ..... 18166277

(51) Int. Cl.
*A47L 9/10* (2006.01)
*A47L 5/36* (2006.01)
*A47L 9/16* (2006.01)

(52) U.S. Cl.
CPC ..... *A47L 9/104* (2013.01); *A47L 5/365* (2013.01); *A47L 9/1633* (2013.01);
(Continued)

(58) Field of Classification Search
CPC ..... A47L 5/365; A47L 9/104; A47L 9/1658; A47L 9/1683; A47L 9/16; A47L 9/165;
(Continued)

(56) References Cited

U.S. PATENT DOCUMENTS 6,332,239 B1 12/2001 Dubos et al.
7,294,159 B2 * 11/2007 Oh ..... A47L 9/1625 55/459.1

(Continued)

FOREIGN PATENT DOCUMENTS

EP 0776686 A1 * 11/1996 ..... B01D 45/16
EP 1541278 A1 6/2005

(Continued)

OTHER PUBLICATIONS

EP-0776686-A1 description in English Espacenet (Year: 2022).*

(Continued)

*Primary Examiner* — Joseph J Hail
*Assistant Examiner* — Timothy Brady
(74) *Attorney, Agent, or Firm* — Davidson, Davidson & Kappel, LLC

(57) ABSTRACT

A separating device that is connectable to a vacuuming device for separating dirt particles from an air stream drawn in by the vacuuming device, containing at least one separator. The at least one separator contains an inlet opening for the air stream and a first and second outlet opening, wherein the first outlet opening serves for the exit of drawn-in dirt particles from the separator and the second outlet opening serves for the exit of the drawn-in air stream and of the drawn-in dirt particles from the separator, and wherein a first and second collection vessel for collecting the dirt particles separated from the separator is contained, and wherein the first collection vessel is positioned in a direction beneath the first outlet opening and the second collection vessel is positioned in a direction beneath the second outlet opening.

21 Claims, 20 Drawing Sheets

(52) U.S. Cl.
CPC ..... *A47L 9/1641* (2013.01); *A47L 9/1658* (2013.01); *A47L 9/1683* (2013.01); *A47L 9/1691* (2013.01)

(58) Field of Classification Search
CPC .... A47L 9/1608; A47L 9/1616; A47L 9/1409; A47L 9/149
USPC ..... 15/353, 347, 352
See application file for complete search history.

(56) References Cited

U.S. PATENT DOCUMENTS

| | | | | |
|---|---|---|---|---|
| 7,323,023 | B2 | 1/2008 | Michele et al. | |
| 7,691,161 | B2 * | 4/2010 | Oh | A47L 9/1633 55/424 |
| 7,950,104 | B2 * | 5/2011 | Yoo | A47L 9/1691 15/352 |
| 2002/0020154 | A1 * | 2/2002 | Yang | A47L 9/1666 55/428 |
| 2006/0090428 | A1 * | 5/2006 | Park | B04C 5/185 15/353 |
| 2006/0168923 | A1 * | 8/2006 | Lee | A47L 9/1625 55/345 |
| 2008/0256911 | A1 * | 10/2008 | Oh | A47L 9/1683 55/459.3 |
| 2009/0193613 | A1 * | 8/2009 | Ruben | A47L 9/1666 15/347 |
| 2009/0307866 | A1 * | 12/2009 | Witter | A47L 9/14 15/353 |
| 2010/0115727 | A1 * | 5/2010 | Oh | A47L 9/1625 96/416 |
| 2010/0205917 | A1 * | 8/2010 | Oh | B04C 3/04 55/342 |
| 2010/0251508 | A1 * | 10/2010 | Ni | A47L 9/1683 55/423 |
| 2011/0225764 | A1 * | 9/2011 | Muhlenkamp | A47L 9/1683 15/347 |
| 2012/0180255 | A1 * | 7/2012 | Park | A47L 9/165 15/353 |
| 2013/0055691 | A1 * | 3/2013 | Kim | A47L 9/1625 55/343 |
| 2019/0125153 | A1 * | 5/2019 | Loveless | A47L 9/1683 |
| 2019/0134647 | A1 * | 5/2019 | Hayamitsu | A47L 9/16 |

FOREIGN PATENT DOCUMENTS

| | | | | |
|---|---|---|---|---|
| EP | 3361923 | B1 * | 8/2019 | A47L 9/1608 |
| FR | 2558741 | A1 | 8/1985 | |
| FR | 2778546 | A1 | 11/1999 | |
| WO | WO-03030703 | A2 * | 4/2003 | A47L 9/104 |
| WO | WO 03030703 | A2 | 4/2003 | |
| WO | WO-2005077242 | A2 * | 8/2005 | A47L 9/1608 |
| WO | WO-2017063703 | A1 * | 4/2017 | A47L 9/1608 |

OTHER PUBLICATIONS

EP-3361923-B1 description in English Espacenet (Year: 2022).*
WO-03030703-A2 description in English Espacenet (Year: 2022).*
WO-2005077242-A2 description in English Espacenet (Year: 2022).*
WO-2017063703-A1 description in English Espacenet (Year: 2022).*
International Search Report of PCT/EP2019/056426, dated Jun. 17, 2019.

* cited by examiner

A
B

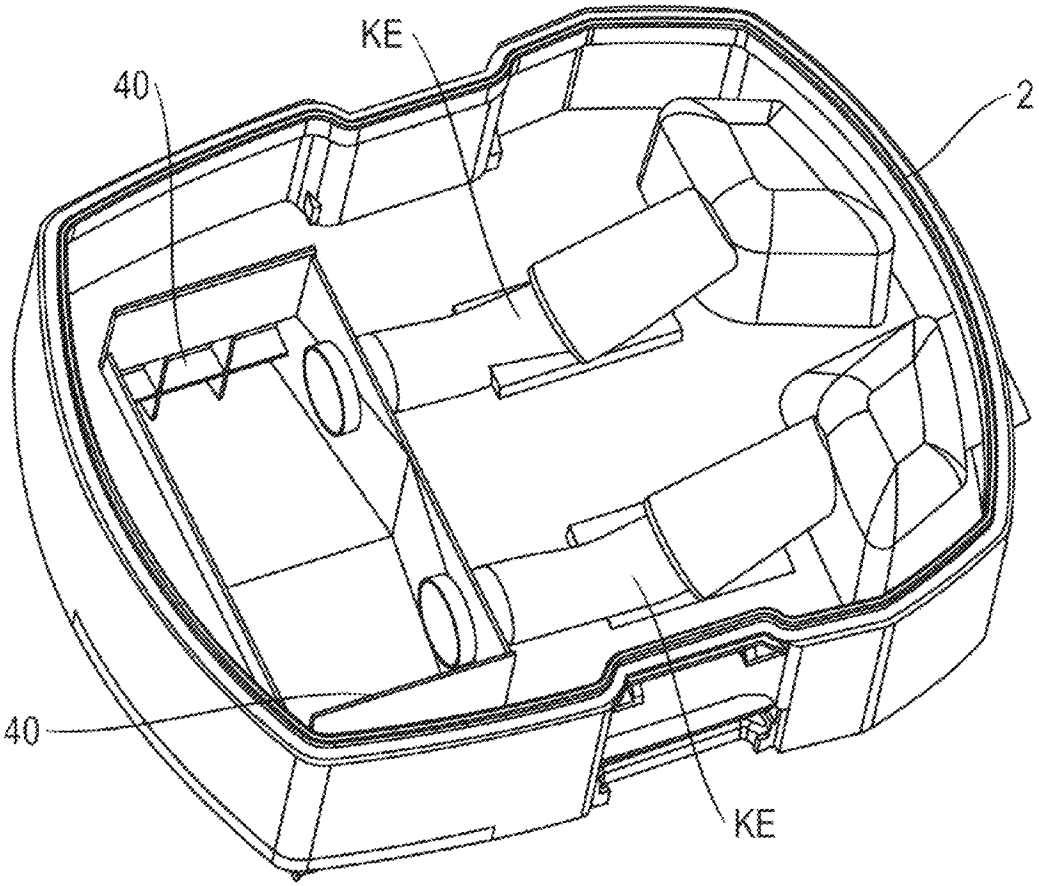
Fig. 19
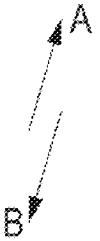

SEPARATING DEVICE FOR A VACUUMING DEVICE

The present invention relates to a separating device that is connectable to a vacuuming device for separating dirt particles from an air stream drawn in by the vacuuming device, containing at least one separator.

BACKGROUND

During the machining of a porous material with a power tool, in particular a drilling machine or a saw, a quantity of dust usually arises, which can swirl up and as a result considerably reduce the clear view of the working surface and the work performance in general. Usually, a vacuuming device or vacuum cleaner is used in combination with the power tool, in order to draw in the swirled-up dust.

The vacuuming device usually contains a filter for retaining dust and dirt particles that pass into the interior of the vacuuming device from the drawn-in air. Without a filter, the drawn-in dust or the drawn-in dirt particles could damage the turbine that serves to generate a negative pressure inside the vacuuming device, and/or the sensitive electronics of the vacuuming device that serve to control, regulate and monitor the vacuuming device.

During the use of the vacuuming device, the drawn-in dust and the drawn-in dirt particles settle in the pores of the filter. As a result of the settling of the dust and the dirt particles, after a certain time, the filter is clogged so much that there is no longer a sufficient filtering action.

In order to protect the filter of a vacuuming device from an excessive quantity of drawn-in dust and dirt particles and to lengthen the period of use of the filter, a separator can be used in the vacuuming device. The separator serves to separate out dirt particles that are in the drawn-in air and is accordingly positioned in the vacuuming device such that the majority of the drawn-in dirt particles have already been removed from the air before the air flows through the filter. As a result of the majority of the dirt particles being separated by means of the separator, the period of use of the filter can be lengthened.

Vacuuming devices with a separate separating device are already available on the market. However, the vacuuming devices with a separating device that are available on the market have the problem that the separating device is completely filled with drawn-in dust and dirt particles after a just a relatively short time, with the result that the function of the separating device is no longer ensured.

Furthermore, these separating devices that are already available on the market are usually fastened as a separate component to the vacuuming device from the outside. Fastening to the vacuuming device is complicated and makes the vacuuming device larger and more difficult to handle.

SUMMARY OF THE INVENTION

An object of the present invention is to solve the above-described problem and in particular to provide a compact separating device for a vacuuming device with a longer period of use or service life.

The present invention provides a separating device that is connectable to a vacuuming device for separating dirt particles from an air stream drawn in by the vacuuming device, containing at least one separator.

According to the invention, the at least one separator contains an inlet opening for the air stream and a first and second outlet opening, wherein the first outlet opening serves for the exit of drawn-in dirt particles from the cyclone separator and the second outlet opening serves for the exit of the drawn-in air stream and of the drawn-in dirt particles from the separator, and wherein a first and second collection vessel for collecting the dirt particles separated from the separator is contained, and wherein the first collection vessel is positioned in a direction beneath the first outlet opening and the second collection vessel is positioned in a direction beneath the second outlet opening. Since the dirt particles separated by the separator can be discharged through the first and second outlet opening into the corresponding collection vessel, the separating device is continually emptied. In this way, clogging of the separating device with dirt particles is prevented and the period of use or service life of the separating device is lengthened.

In this case, the separator can be configured in the form of a cyclone separator.

It is also possible for more than a first and second collection vessel for collecting the dirt particles separated from the cyclone separator to be contained. It is also possible in this case for only one collection vessel to be provided.

The cyclone separator can also be referred to as a centrifugal separator, cyclone, cyclone filter or cyclone dust catcher.

According to an advantageous embodiment of the separating device according to the invention, it may be possible for the cyclone separator to be configured in the form of an axial separator with a first and a second tube, wherein the second tube is releasably positionable at least partly in the first tube and wherein the first outlet opening is provided in the form of a cutout in the lateral surface of the first tube and at an annular gap between the first and second tube. The first and second tube are in this case connectable releasably together. As a result of the cyclone separator being configured in the form of an axial separator, effective and space-saving separation of dirt particles from the separating device can be achieved. As a result of the cyclone separator being configured with a first and second tube, which are connected releasably together, the cyclone separator can be taken apart into its main components and cleaned. Furthermore, it is also possible to replace the first and/or second tube in the event of damage, with the result that it is not necessary to replace the entire cyclone separator.

According to an alternative embodiment, the cyclone separator can be configured such that the first and second tube are connected fixedly together.

In accordance with a further advantageous embodiment of the separating device according to the invention, it may be possible for a bottom element of the first and second collection vessel to be configured in the form of a nonreturn flap, such that, as a result of the bottom element configured as a nonreturn flap being opened, the dirt particles collected in the collection vessel can drop out of the collection vessel. The bottom element can in this case also be referred to as an opening element. The separating device can in this case be positioned with respect to a collecting tank of the vacuuming device such that the bottom element, configured as a nonreturn flap, of the first and second collection vessel can be opened toward the collecting tank. As a result, it is possible, with the aid of gravity, for the dirt particles collected in the collection vessel to be conveyed into the collecting tank of a vacuuming device. As a result of the bottom element being configured in the form of a nonreturn flap, it is possible to effectively prevent air and dirt particles from being able to pass from the collecting tank of the vacuuming device via the collection vessel into the cyclone separator or into the separating device.

According to a further advantageous embodiment of the separating device according to the invention, it may be possible for the nonreturn flap to be configured in an elastically deformable manner. As a result, a nonreturn flap that functions in a virtually silent manner can be realized easily.

In accordance with a further advantageous embodiment of the separating device according to the invention, it may be possible for the the separating device to contain a frame housing, which is positionable between a suction head and a collecting tank of the vacuuming device. As a result, the separating device can be retrofitted in a modular manner into existing vacuuming devices with a suction head and a collecting tank.

Further advantages will become apparent from the following description of the figures. Various exemplary embodiments of the present invention are illustrated in the figures. The figures, the description and the claims contain numerous features in combination. A person skilled in the art will expediently also consider the features individually and combine them to form expedient further combinations.

BRIEF DESCRIPTION OF THE DRAWINGS

In the figures, identical and similar components are denoted by the same reference signs. In the figures:

FIG. 19 shows a perspective view of a separating device according to the invention according to the alternative exemplary embodiment.

DETAILED DESCRIPTION

Figure 1:
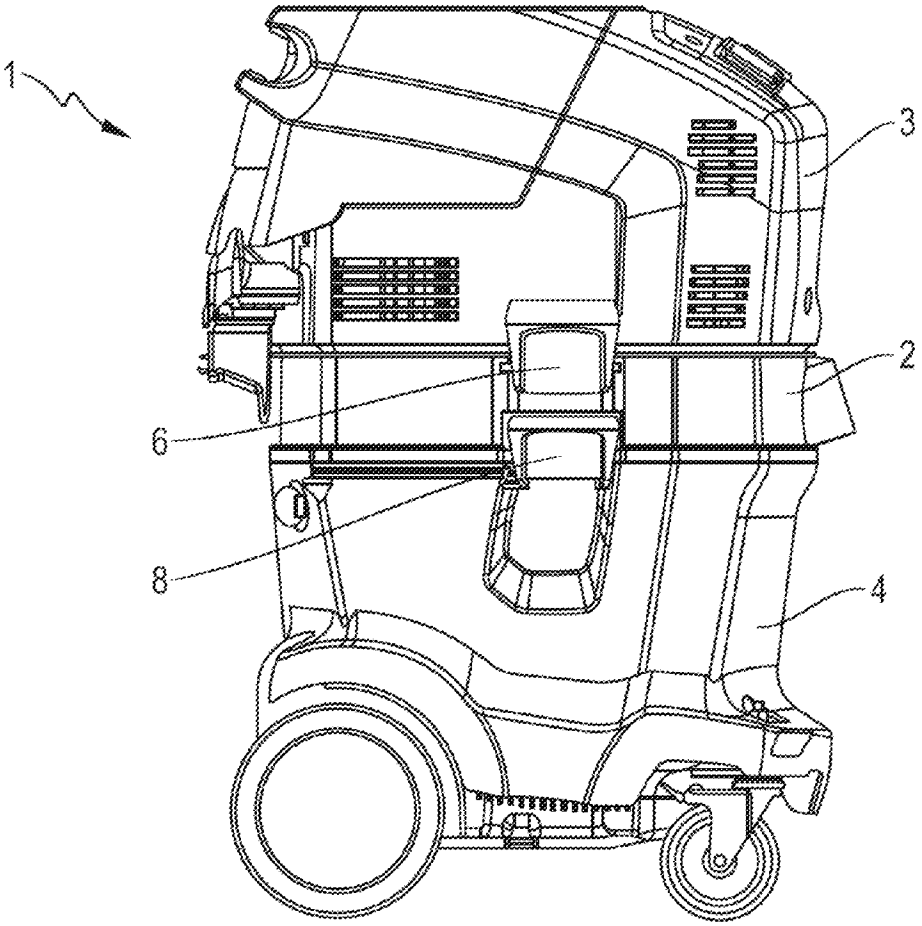
FIG. 1 shows a side view of a vacuuming device having a separating device according to the invention.
Figure 2:
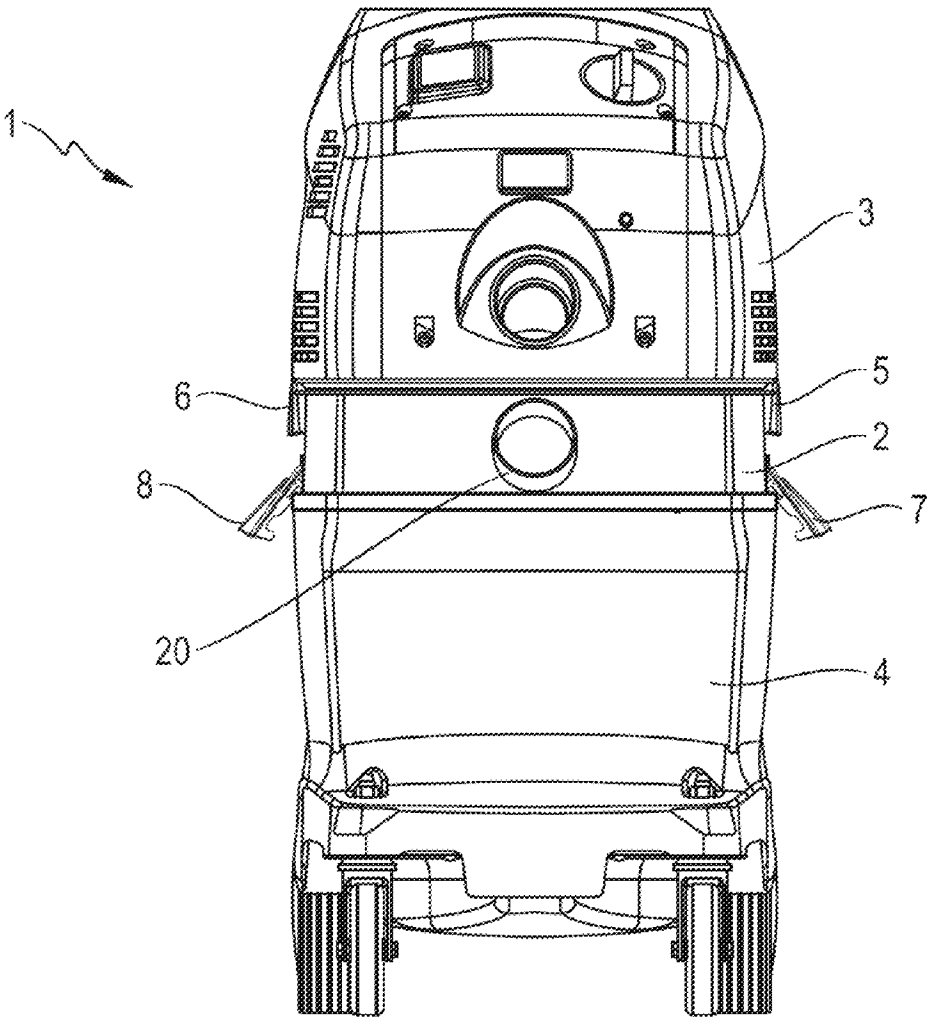
FIG. 2 shows a front view of the vacuuming device having the separating device according to the invention.
Figure 3:
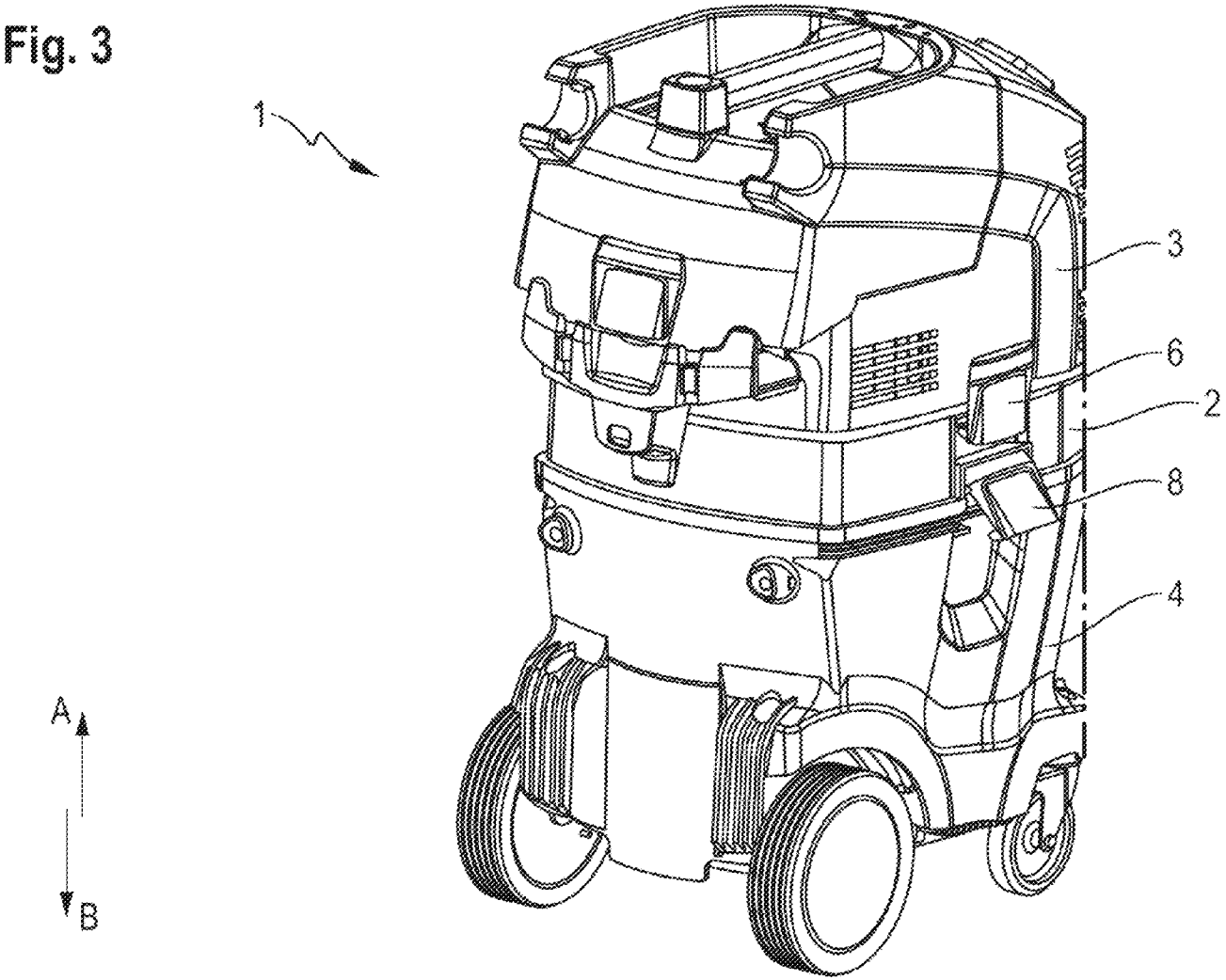
FIG. 3 shows a perspective rear view of the vacuuming device having the separating device according to the invention.
Figure 4:
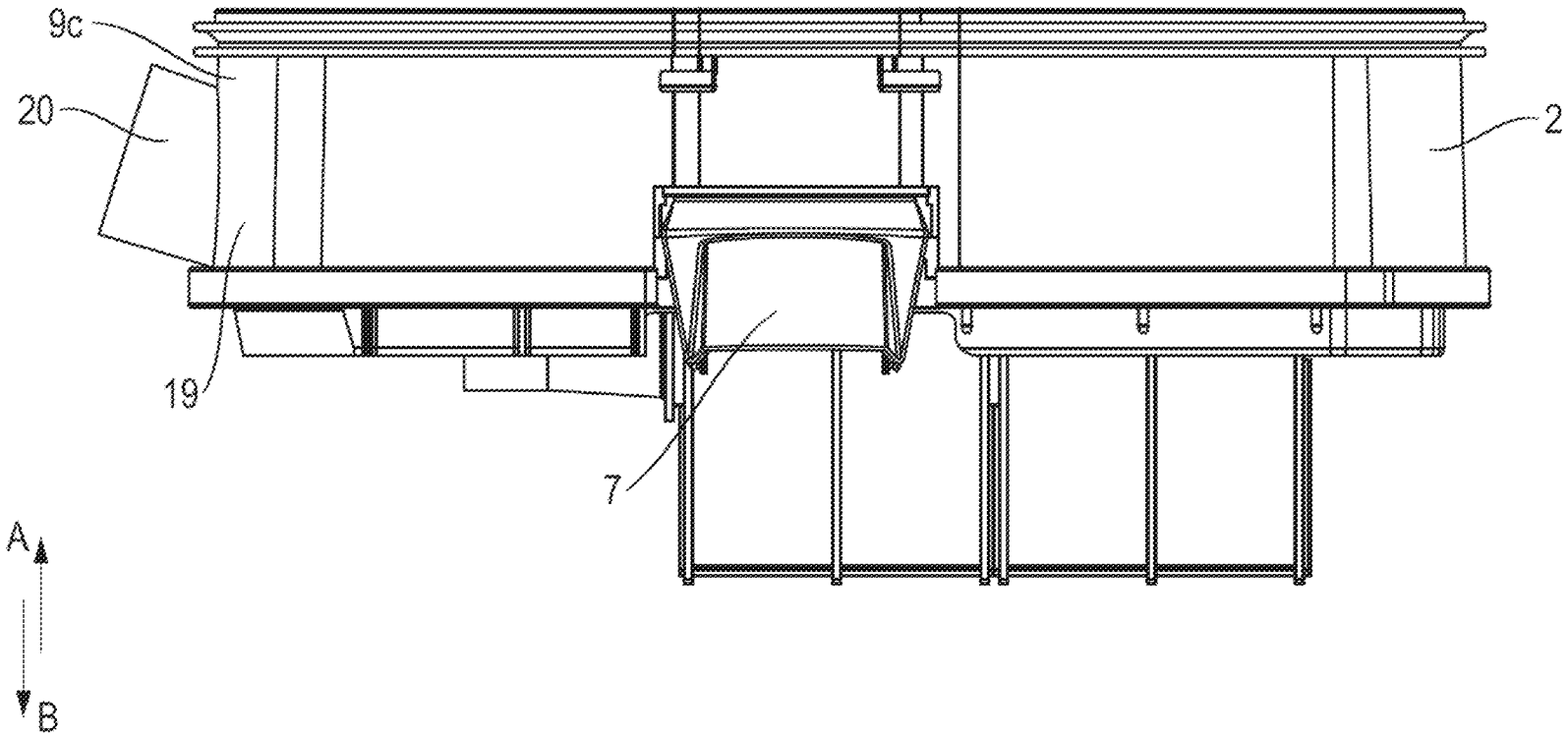
FIG. 4 shows a side view of the separating device according to the invention.
Figure 5:
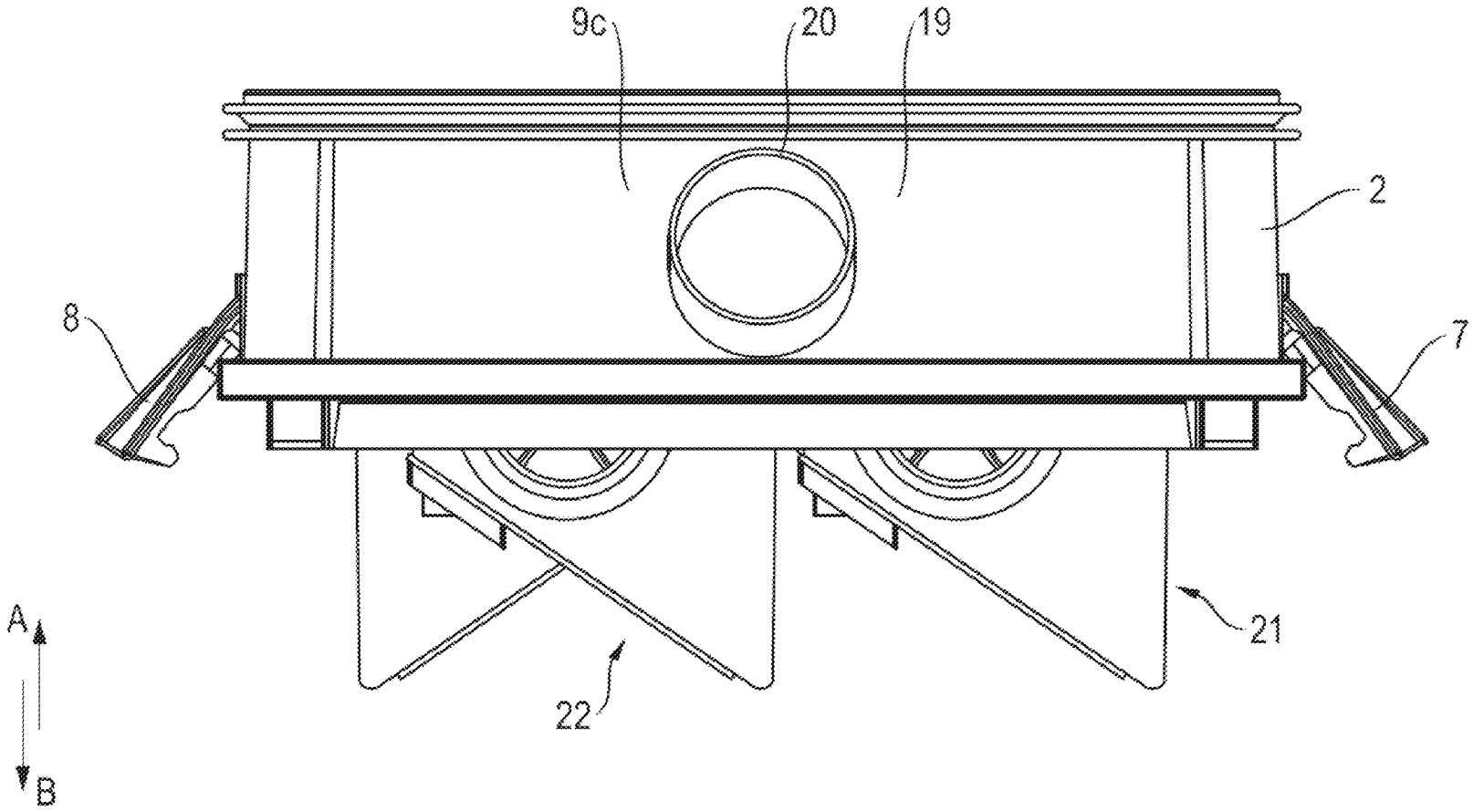
FIG. 5 shows a front view of the separating device according to the invention.

FIGS. 1, 2 and 3 show a separating device 2 according to the invention connected to a vacuuming device 1 for separating dirt particles from an air stream LS drawn in by the vacuuming device 1.

The vacuuming device 1 contains substantially a suction head 3 and a collecting tank 4. The suction head 3 is in this case positioned in the arrow direction A above the collecting tank 4 and releasably connected thereto. The separating device 2 is in this case releasably connected to the suction head 3 by means of a first and second clip lock 5, 6, and releasably connected to the collecting tank 4 by means of a third and fourth clip lock 7, 8, such that the separating device 2 is positioned between the suction head 3 and the collecting tank 4.

The suction head 3 in this case contains substantially a turbine for generating a negative pressure in the vacuuming device 1 and a controller with electronics that serve to control, regulate and monitor the vacuuming device 1. By means of the negative pressure, ambient air can be drawn in to collect dust and dirt particles in the interior of the vacuuming device 1.

The collecting tank 4 is configured substantially in the form of a tub with a cavity for receiving dust and dirt particles.

FIGS. 4 to 12 illustrate the separating device 2 according to the invention according to a first exemplary embodiment. The separating device 2 contains in this case substantially a frame housing 9, a first and second separator 21, 22 and a first, second, third and fourth collection vessel 12, 13, 14, 15.

The frame housing 9 is configured substantially in the form of a tub with a bottom wall 16 and contains an upper end 9*a*, and lower end 9*b*, a front end 9*c* and a rear end 9*d*. The bottom wall 16 in turn contains a top side 16*a* and an underside 16*b*. Furthermore, the frame housing 9 contains a side wall 17. The side wall 17 extends around the entire frame housing 9 and contains an inflow duct 18 at a front end 9*c* of the frame housing 9. An inflow port 20 is positioned on an outer side 19 of the side wall 17 and likewise at the front end 9*c* of the frame housing 9.

According to an alternative embodiment, the inflow port 20 can also be integrated in the collecting tank 4. The inflow port 20 serves for fastening one end of a vacuum cleaner hose. The inflow port 20 and the inflow duct 18 are fluidically connected together such that an air stream LS drawn in by the vacuuming device 1 can flow through the inflow port 20 and the inflow duct 18 to the underside 16*b* of the bottom wall 16.

On the underside of the bottom wall 16 is the first and second separator 21, 22. Both the first and second separator 21, 22 are configured in the form of an axial separator or as an axial cyclone separator. However, it is also possible for some other type of separator, for example a cyclone separator, tangential cyclone separator or multicyclone, to be used. It is not necessary here for the first and second separator 21, 22 to be identical in construction. The first and second separator 21, 22 are positioned parallel to one another and oriented such that a drawn-in air stream LS can flow simultaneously through the first and second separator 21, 22. According to an alternative embodiment, it is also possible for more than a first and second separator 21, 22 to be provided. It is also possible in this case for only one separator to be provided.

In accordance with a further alternative exemplary embodiment, a series arrangement with a plurality of separator cascades, which each consist of one or more separators, can be provided.

As is apparent from FIGS. 11, 12, 13, 15 and 16, the first and second separator 21, 22 each substantially contain a first and second tube 21*a*, 22*a*, 21*b*, 22*b*. In the separator 21, 22 configured as a cyclone separator, the first tube 21*a*, 22*a* serves as the feed tube and the second tube 21*b*, 22*b* as the dip tube, respectively. The first and second separator 21, 22 furthermore each contain an inlet opening 23 for an air stream LS drawn in by the vacuuming device 1 and each contain a first and second outlet opening 21*c*, 22*c*, 21*d*, 22*d*. The first outlet opening 21*c*, 22*c* serves for the exit of drawn-in dirt particles from the separator 21, 22 and the second outlet opening 21*d*, 22*d* serves for the exit of the drawn-in air stream LS and the drawn-in dirt particles from the separator 21, 22.

The first tube 21*a*, 22*a* consists in this case of a cylindrical part and a conical part. Positioned in the cylindrical part is a guide device in the form of guide vanes 23*a* for generating swirl in the drawn-in air stream LS. Provided in the middle of the cylindrical part of the first tube 21*a*, 22*a*, on a lateral surface, is an annular elevation 24, which extends around the lateral surface and serves for fastening the first tube 21*a*, 22*a* to the collection vessel 12, 14. Furthermore, the first outlet opening 21*c*, 22*c* in the form of a cutout is provided in the lateral surface of the conical part, cf. FIG. 16. The first outlet opening 21*c*, 22*c* serves as an exit opening for dirt particles that have accumulated in the first tube 21*a*, 22*a* of the separator 21, 22.

The second tube 21*b*, 22*b* likewise consists of a cylindrical part and a conical part. Provided in the middle of the cylindrical part of the second tube 21*b*, 22*b*, on a lateral surface, are a first and a second annular elevation 26, 27. Both the first and the second annular elevation 26, 27 extend around the lateral surface. The first annular elevation 26 serves for the releasable fastening of the second tube 21*b*, 22*b* to the first tube 21*a*, 22*a*. The free end 28 of the conical part of the first tube 21*a*, 22*a* in this case enters into a plug connection with the first annular elevation 26 of the second tube 21*b*, 22*b*. The second annular elevation 27 serves in each case for fastening the second tube 21*b*, 22*b* to the collection vessel 13, 15. The second outlet opening 21*d*, 22*d* is provided at the free end of the second tube 21*b*, 22*b* and serves for the outflow of the air stream LS drawn into the separator 21, 22 and the dirt particles still remaining the drawn-in air stream LS.

Figure 17:
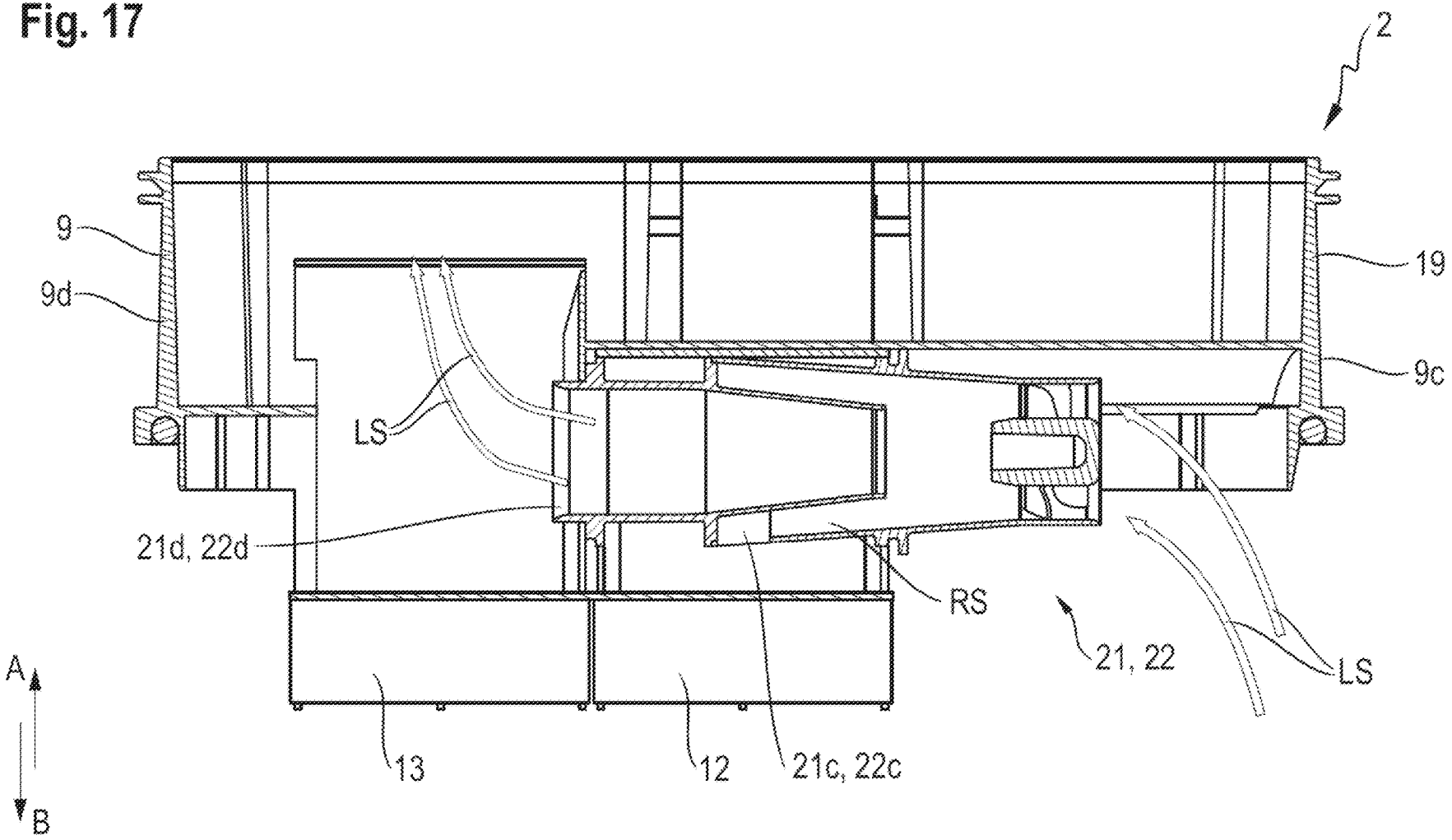
FIG. 17 shows a lateral sectional view through a separating device according to the invention and through a cyclone separator.

As shown in FIG. 17, the second tube 21*b*, 22*b* is positioned partly in the first tube 21*a*, 22*a*. A certain part of the second tube 21*b*, 22*b* extends outside the first tube 21*a*, 22*a*. Between the first tube 21*a*, 22*a* and the second tube 21*b*, 22*b*, an annular gap RS forms as a result, in which dirt particles collect, which are drawn in by the vacuuming device 1 together with the air stream LS.

As already mentioned above, the separating device 2 furthermore contains a first, second, third and fourth collection vessel 12, 13, 14, 15, which are likewise positioned on the underside 16*b* of the bottom wall 16. The first separator 21 is in this case positioned in the first and second collection vessels 12, 13 and the second separator 22 is positioned in the third and fourth collection vessels 14, 15.

The collection vessel 12, 13, 14, 15 in this case contains substantially a wedge-shaped box 30 with a cylindrical pipe 31.

The wedge-shaped box 30 contains a first side wall 30*a*, a second side wall 30*b*, a rear wall 30*c* and a bottom element 30*d*. The inclined plane 32 of the wedge-shaped box 30 in this case forms the bottom element 30*d* of the collection vessel 12, 13, 14, 15. The bottom element 30*d* is configured in the form of a nonreturn flap, such that, as a result of the nonreturn flap being opened in the arrow direction R, R', the dirt particles that have collected in the collection vessel 12, 13, 14, 15 can drop out of the collection vessel 12, 13, 14, 15 in the direction B, cf. FIG. 6. The bottom element 30*d* configured as a nonreturn flap is in this case configured in an elastically deformable manner, such that the nonreturn flap 30*d* is movable reversibly between an open and a closed position. In FIGS. 4 to 12, the bottom element 30*d* configured as a nonreturn flap is illustrated in the closed position.

Figure 6:
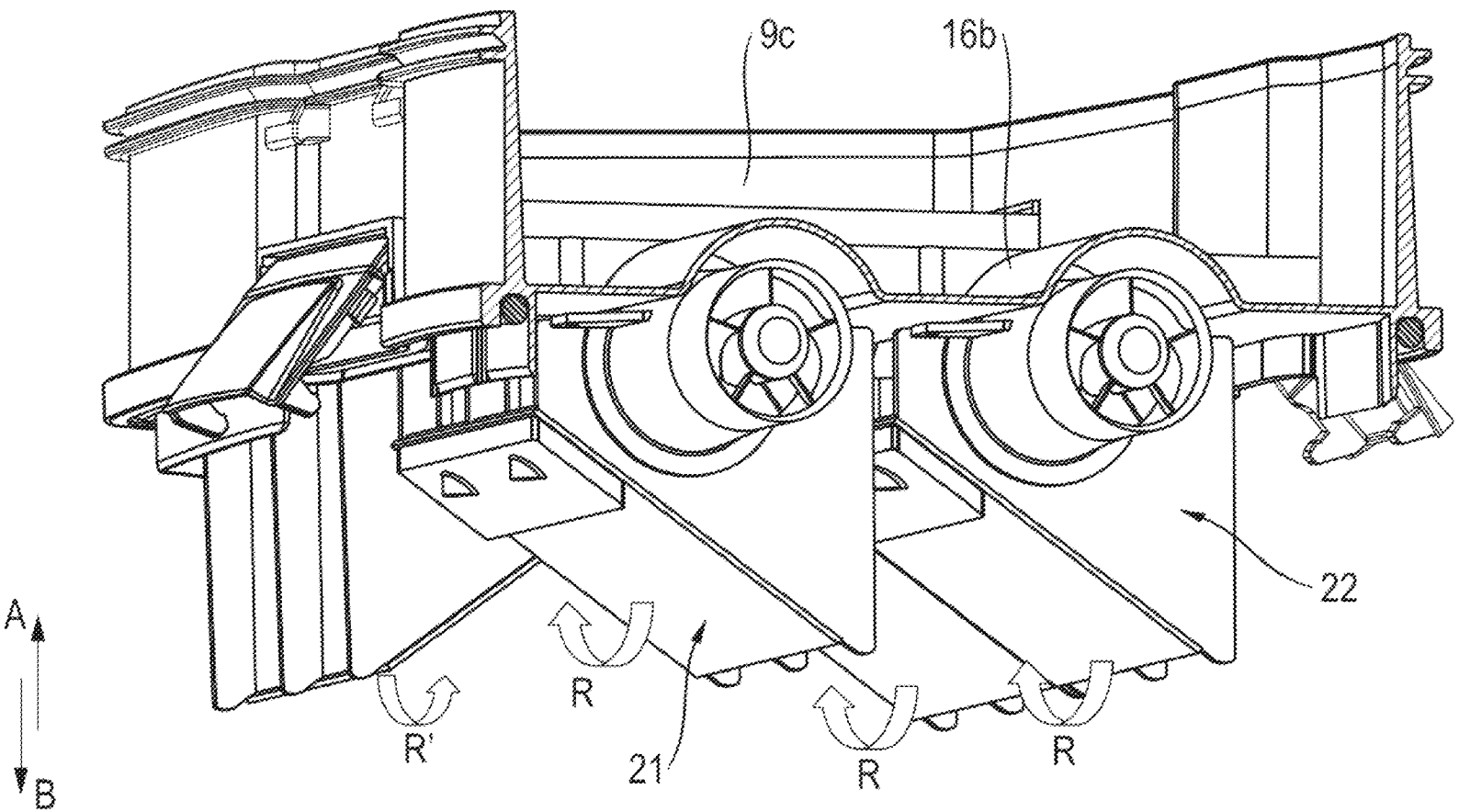
FIG. 6 shows a perspective rear view of the separating device according to the invention, wherein a rear part of a frame housing of the separating device is cut away.
Figure 7:
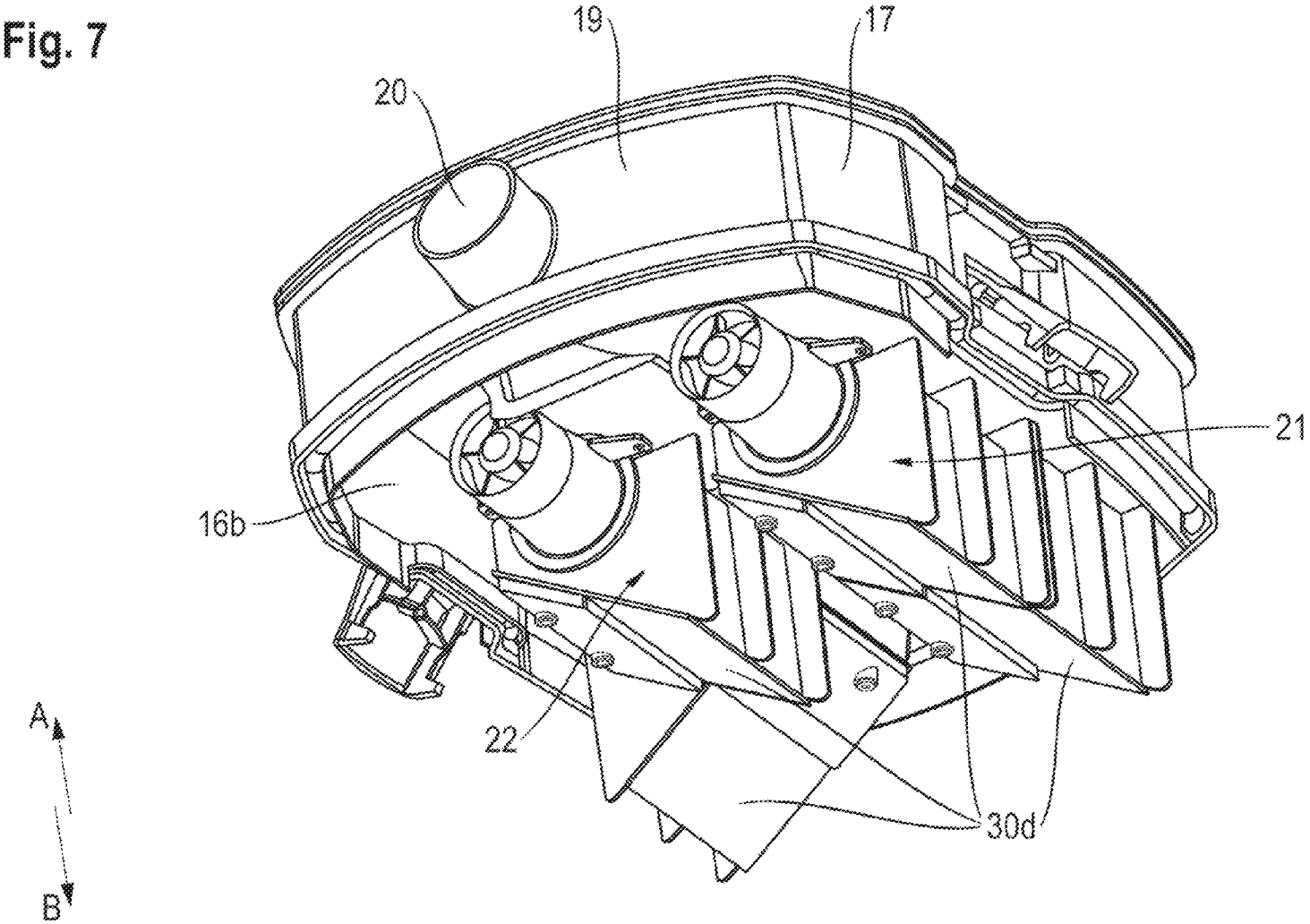
FIG. 7 shows a first perspective bottom view of the separating device according to the invention.
Figure 8:
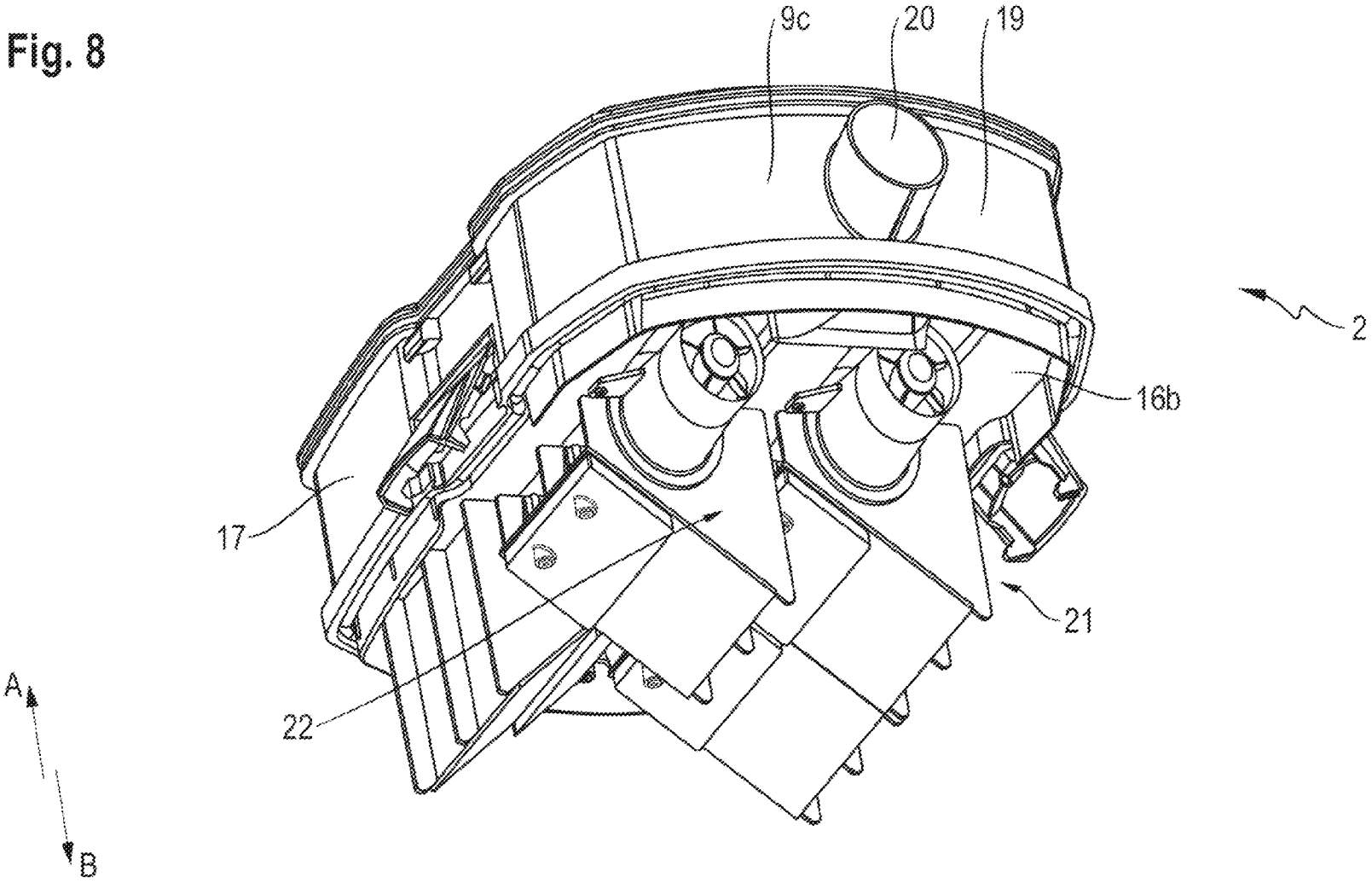
FIG. 8 shows a second perspective bottom view of the separating device according to the invention.
Figure 9:
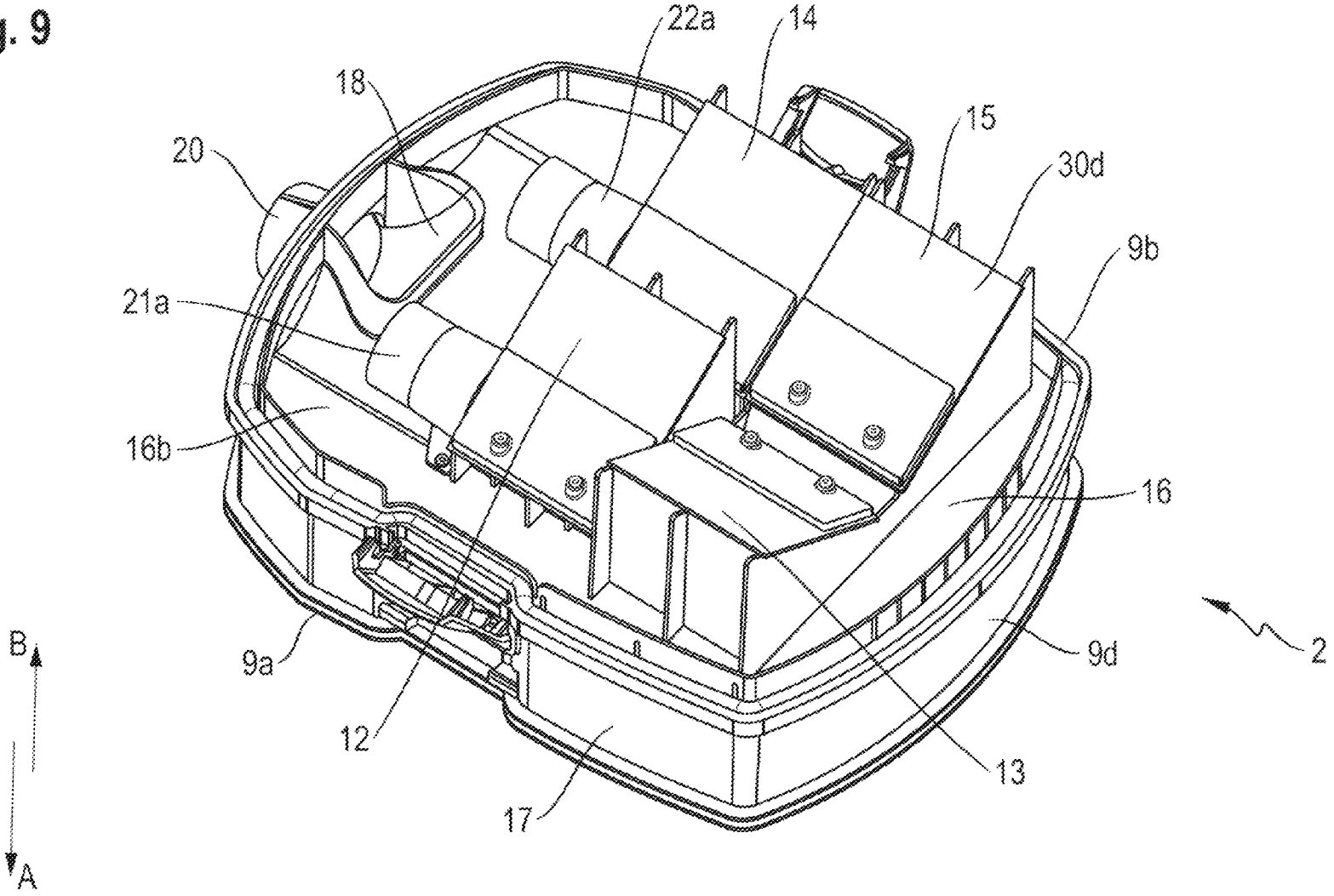
FIG. 9 shows a third perspective bottom view of the separating device according to the invention.
Figure 10:
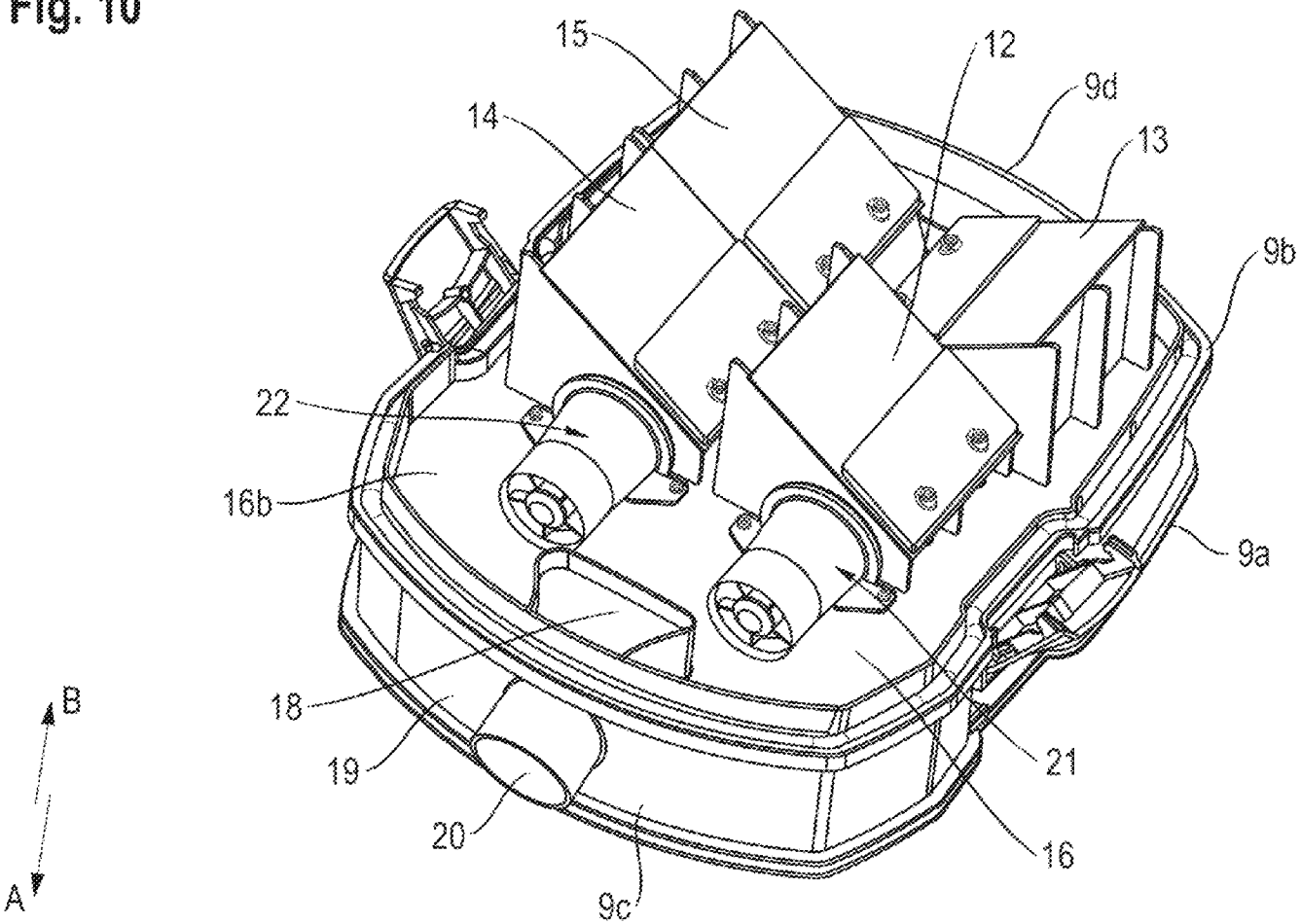
FIG. 10 shows a fourth perspective bottom view of the separating device according to the invention.
Figure 11:
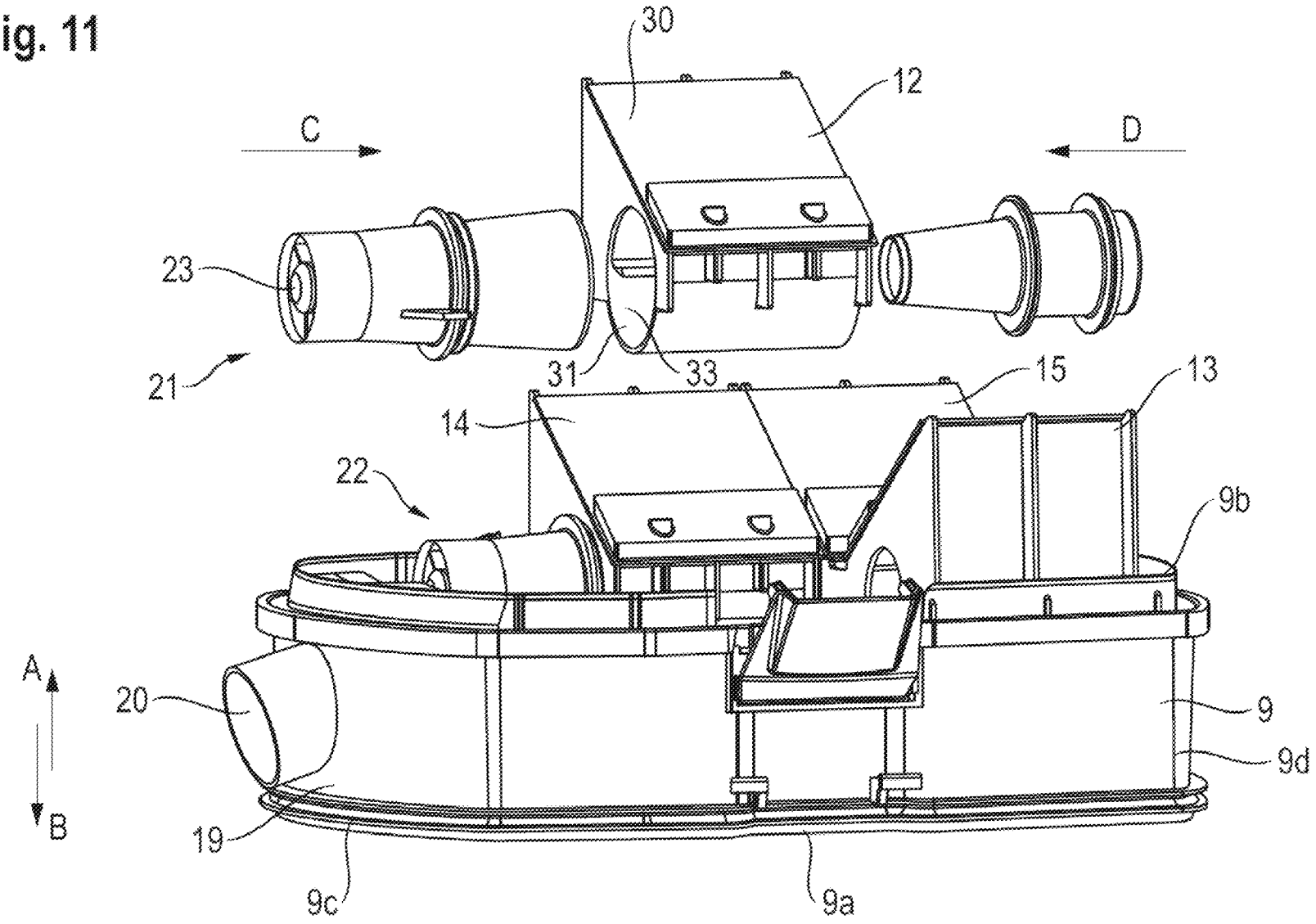
FIG. 11 shows a perspective side view of the separating device according to the invention with a first and second cyclone separator, wherein the first cyclone separator is illustrated in an exploded view.
Figure 16:
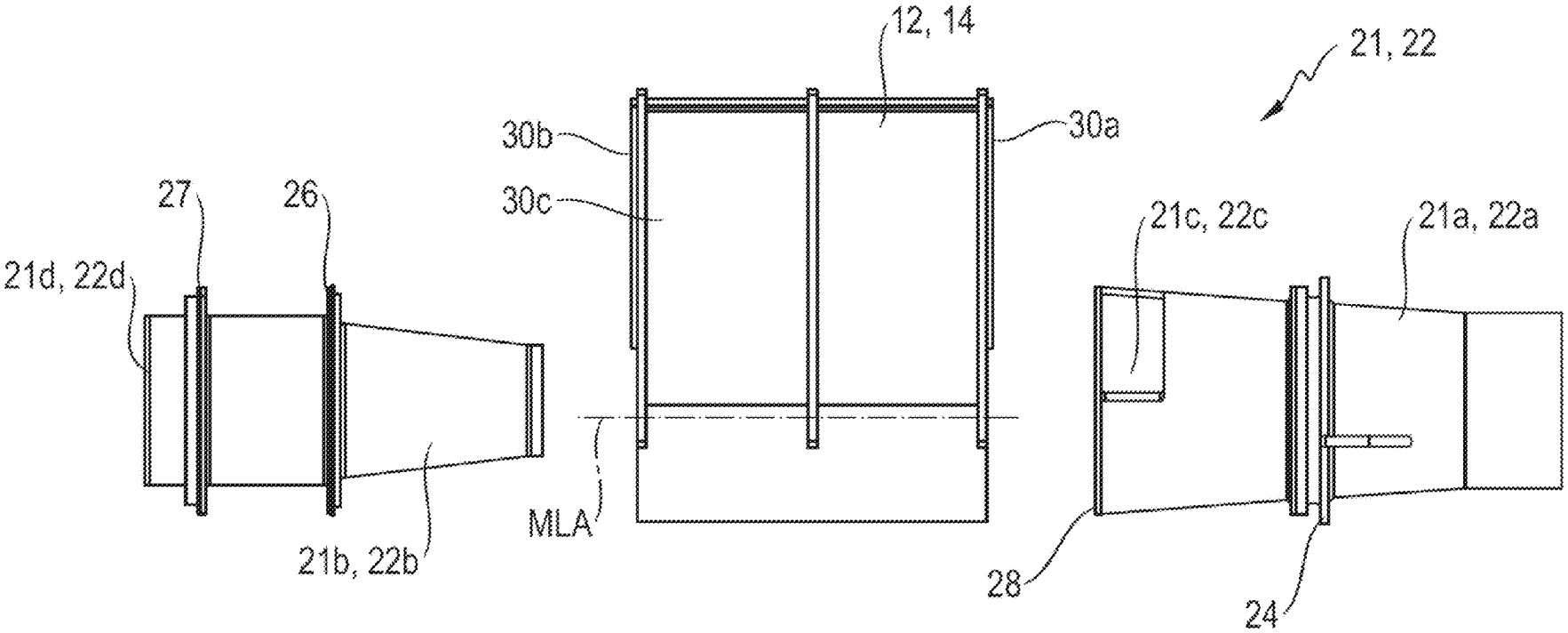
FIG. 16 shows a second perspective side view of a cyclone separator according to a first exemplary embodiment in an exploded view.

As is shown in particular in FIG. 6, FIG. 11 and FIG. 16, the first and second side wall 30*a*, 30*b* each contain a cutout 33 for receiving the cylindrical pipe 31. The cylindrical pipe 31 is in this case arranged with respect to the wedge-shaped box 30 such that the longitudinal center axis MLA of the cylindrical pipe extends parallel to the bottom element 30*d*.

Figure 12:
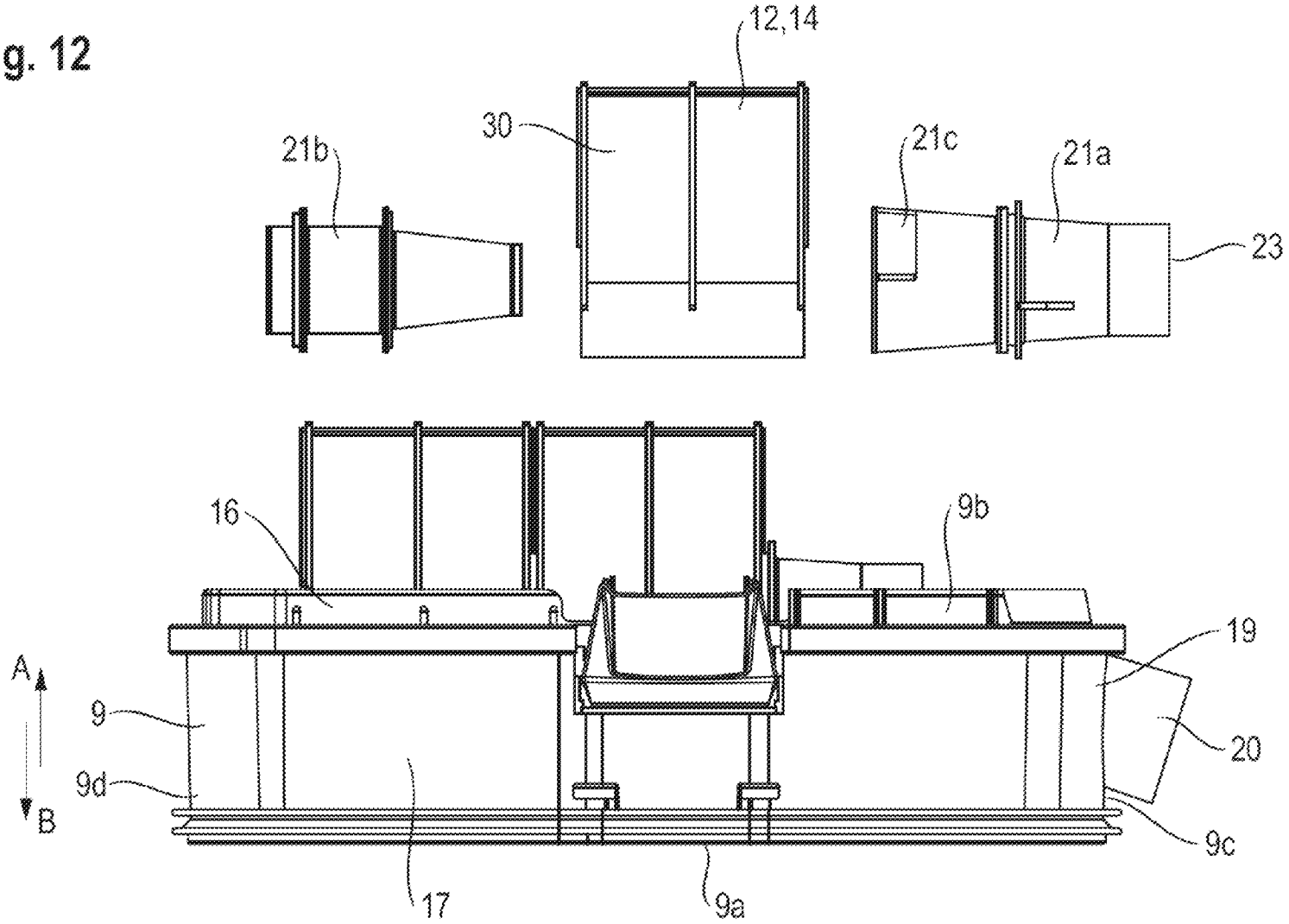
FIG. 12 shows a side view of the separating device according to the invention with a first and second cyclone separator, wherein the first cyclone separator is illustrated in an exploded view.
Figure 13:
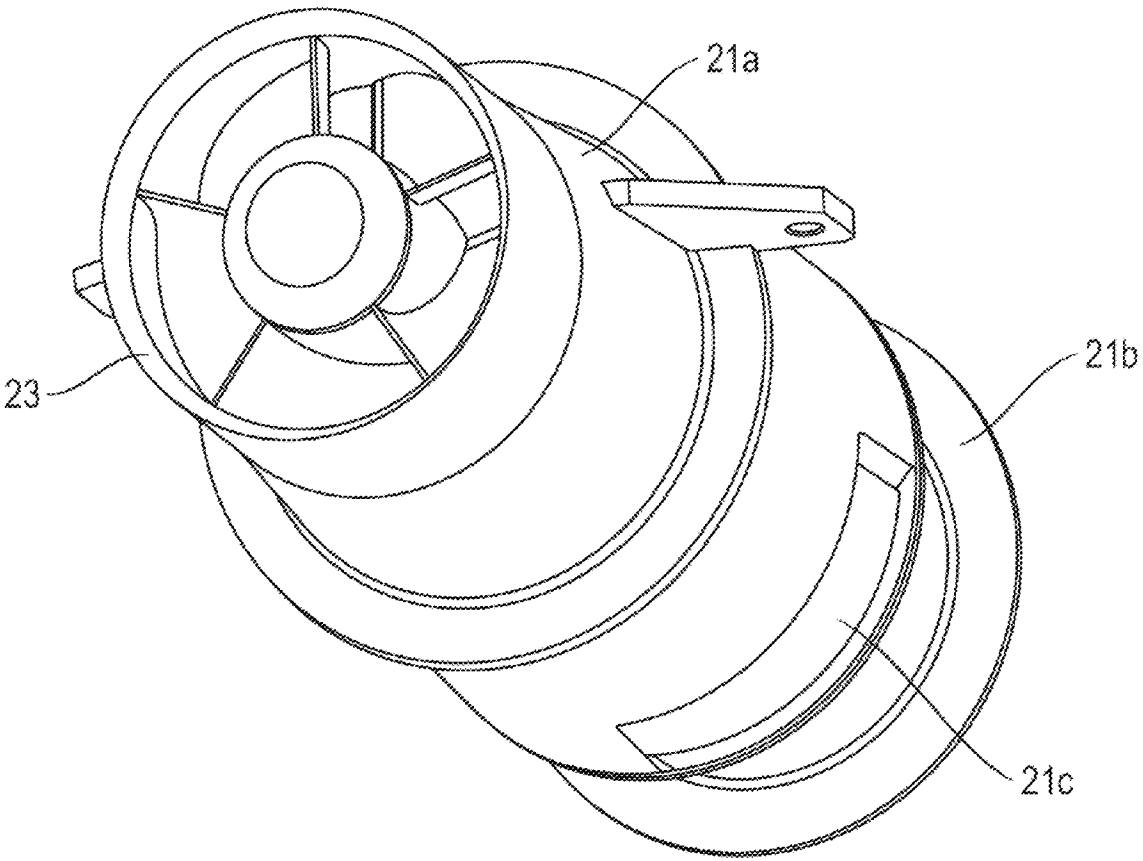
FIG. 13 shows a perspective front view of a cyclone separator according to a first exemplary embodiment.
Figure 14:
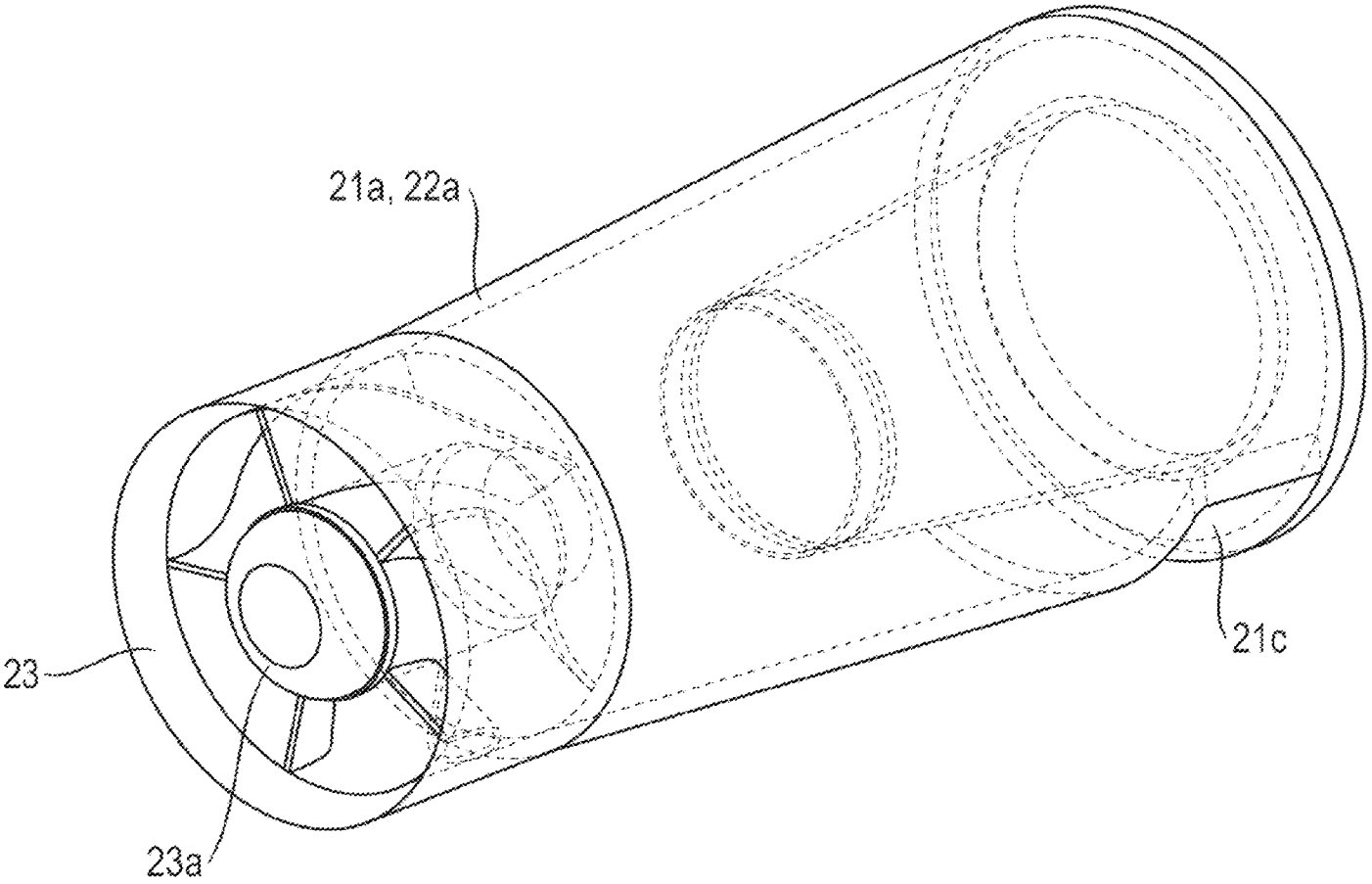
FIG. 14 shows a perspective front view of a cyclone separator according to a second exemplary embodiment.
Figure 15:
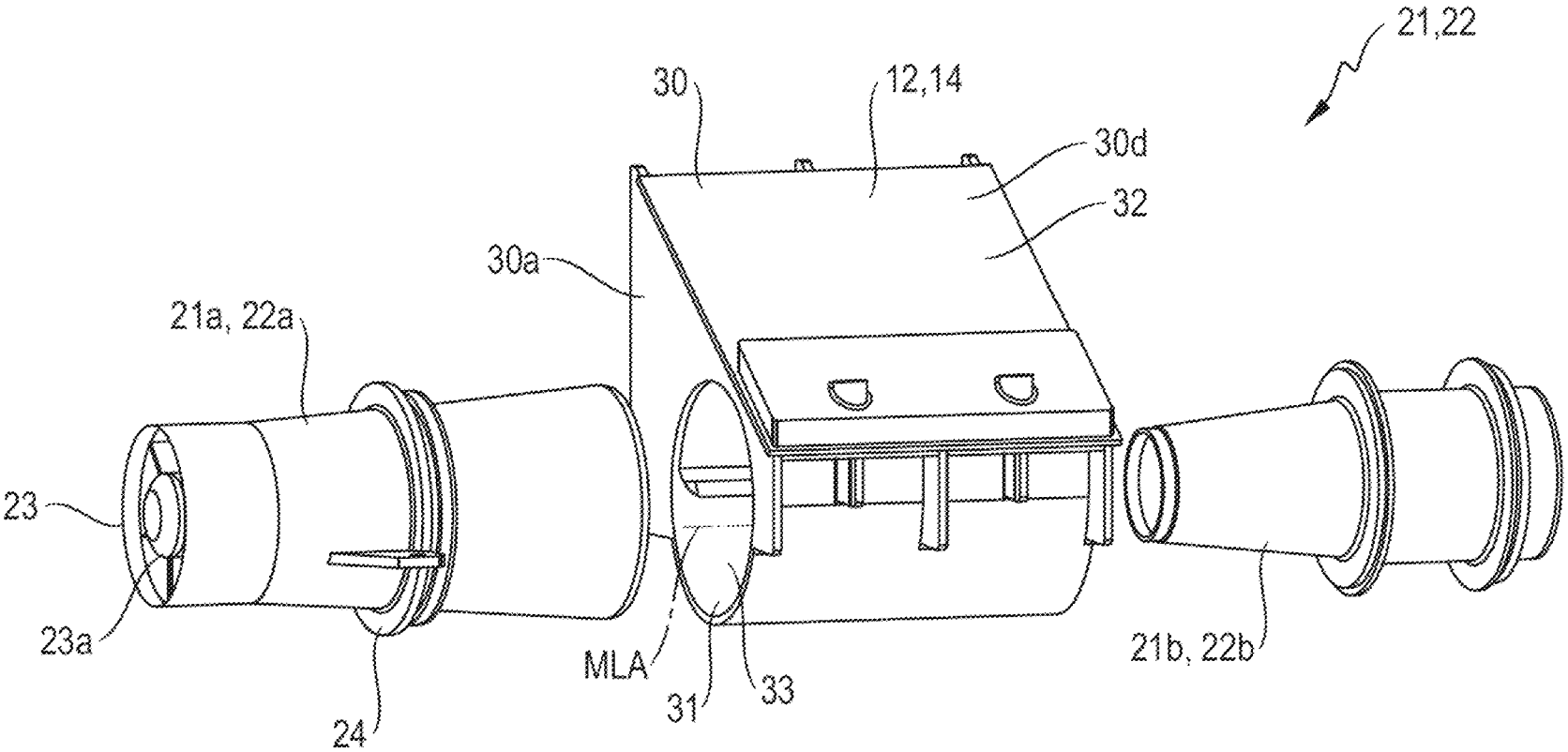
FIG. 15 shows a first perspective side view of a cyclone separator according to a first exemplary embodiment in an exploded view.

As is illustrated in FIG. 11 and FIG. 12, in order to assemble the first separator 21, the first tube 21*a* is plugged into the cylindrical pipe 31 of the first collection vessel 12 in the arrow direction C. The second tube 21*b* is plugged into the cylindrical pipe 31 of the first collection vessel 12 in the arrow direction D. The second tube 21*b* is plugged into the first tube 21*a*. The free end of the second tube 21*b*, which extends out of the cylindrical pipe 31 of the first collection vessel 12, is plugged into the cylindrical pipe 31 of the second collection vessel 13 in the arrow direction C.

The first tube 21*a* of the first separator 21 is arranged in the first collection vessel 12 such that the first outlet opening 21*c*, configured as a cutout, in the first tube 21*a* is directed toward the bottom element 30*d* configured as a nonreturn flap. As a result, dirt particles that have accumulated in the first cyclone separator can drop out of the first separator 21 and into the collecting tank 4 of the vacuuming device 1 through the first outlet opening 21*c*, configured as a cutout, in the first tube 21*a* and through the bottom element 30*d* configured as a nonreturn flap. The second outlet opening 21*d* of the second tube 21*b*, which extends out of the cylindrical pipe 31 of the second collection vessel 13, is located in the arrow direction B above the bottom element 30*d*, configured as a nonreturn flap, of the second collection vessel, cf. FIG. 17.

When the first separator 21 has been assembled and positioned on the underside 16*b* of the bottom wall 16, the inlet opening 23 of the first tube 21*a* is directed toward the inflow port 20 and the inflow duct 18, such that the inflow port 20, the inflow duct 20 and the inlet opening 23 are fluidically connected together in this way. An air stream LS drawn in by the vacuuming device 1 can thus flow through the inflow port 20, the inflow duct 18 and into the inlet opening 23 of the first separator 21. The dirt particles that have been separated in the first separator 21 and pass with the air stream LS into the interior of the first separator 21 reach the first collection vessel 12 through the first outlet opening 21*c*. The air stream LS cleaned of the dirt particles passes out of the first separator 21 via the second tube 21*b* and through the second outlet opening 21*d*. Remaining and in particular relatively small dirt particles that are still located in the drawn-in air stream LS at the end of the second tube 21*b* drop into the second collection vessel 13 under gravity. The dirt particles pass into the collecting tank 4 of the vacuuming device 1 through the bottom element 30*d* configured as a nonreturn flap. The air stream LS, from which virtually all of the dirt particles have now been separated, flows through the filter of the vacuuming device 1.

In order to assemble the second separator 22, the first tube 22*a* of the second separator 22 is plugged into the cylindrical pipe 31 of the third collection vessel 14 in the arrow direction C. The second tube 22*b* of the second separator 22 is plugged into the cylindrical pipe 31 of the third collection vessel 14 in the arrow direction D. The second tube 22*b* is plugged into the first tube 22*a*. The free end of the second tube 22*b*, which extends out of the cylindrical pipe 31 of the third collection vessel 14, is plugged into the cylindrical pipe 31 of the fourth collection vessel 15 in the arrow direction C. The first tube 22*a* of the second separator 22 is in this case arranged in the third collection vessel 14 such that the first outlet opening 22*c*, configured as a cutout, in the first tube 22*a* is directed toward the bottom element 30*d* configured as a nonreturn flap. As a result, dirt particles that have accumulated in the second separator 22 can drop out of the second separator 22 and into the collecting tank 4 of the vacuuming device 1 through the first outlet opening 22*c*, configured as a cutout, in the first tube 22*b* and through the bottom element 30*d* configured as a nonreturn flap. The second outlet opening 22*d* of the second tube 22*b*, which extends out of the cylindrical pipe 31 of the fourth collection vessel 15, is located in the arrow direction B above the bottom element 30*d*, configured as a nonreturn flap, of the fourth collection vessel 15, cf. FIG. 17.

When the second separator 22 has been assembled and positioned on the underside 16*b* of the bottom wall 16, the inlet opening 23 of the first tube 22*a* is directed toward the inflow port 20 and the inflow duct 18, such that the inflow port 20, the inflow duct 18 and the inlet opening 23 are fluidically connected together in this way. An air stream LS drawn in by the vacuuming device 1 can thus flow through the inflow port 20, the inflow duct 18 and into the inlet opening 23 of the second separator 22. The dirt particles that have been separated in the second separator 22 and pass with the air stream LS into the interior of the second separator 22 reach the third collection vessel 14 through the first outlet opening 22*c*. The air stream LS cleaned of the dirt particles passes out of the second separator 22 via the second tube 22*b* and through the second outlet opening 22*d*. Remaining and in particular relatively small dirt particles that are still located in the drawn-in air stream LS at the end of the second tube 22*b* drop into the fourth collection vessel 15 under gravity. The dirt particles pass into the collecting tank 4 of the vacuuming device 1 through the bottom element 30*d* configured as a nonreturn flap. The air stream LS, from which virtually all of the dirt particles have now been separated, flows through the filter of the vacuuming device 1.

Figure 18:
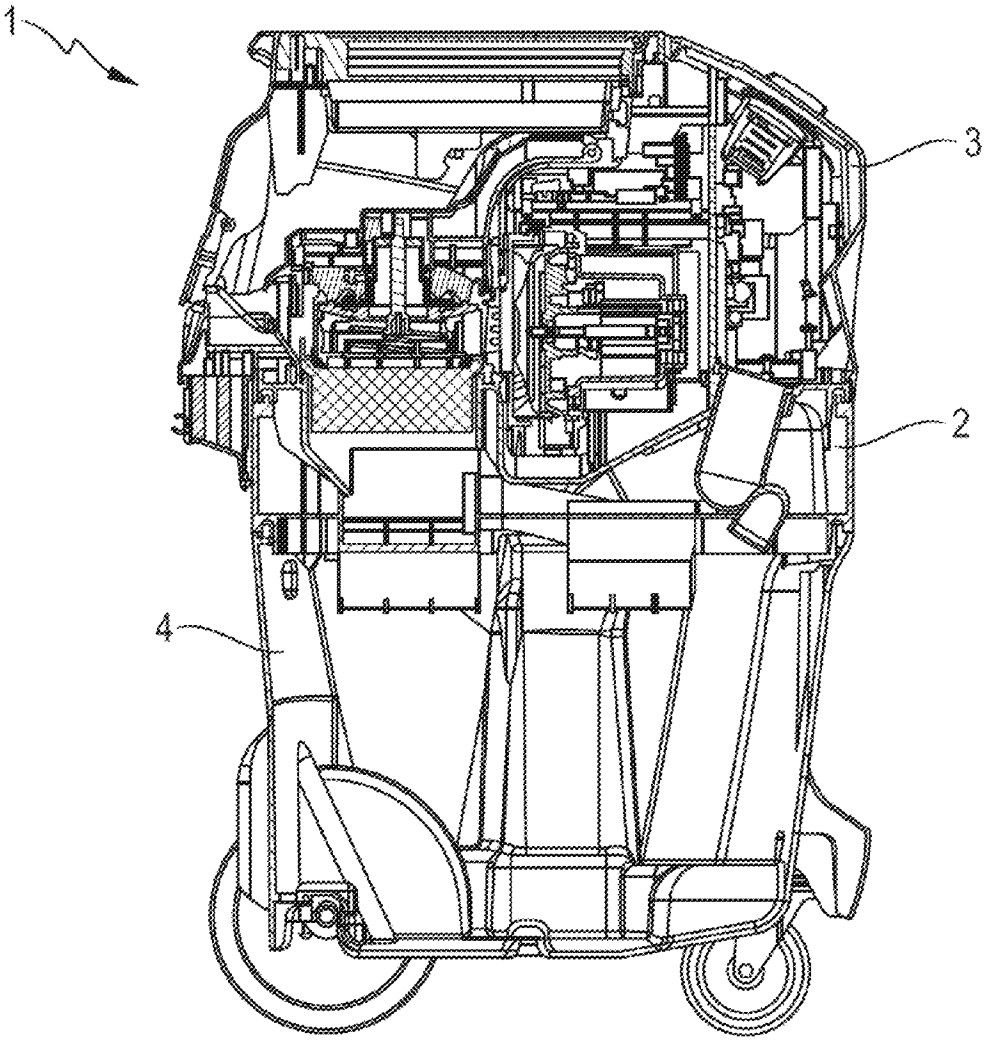
FIG. 18 shows a lateral sectional view through a vacuuming device and a separating device according to the invention according to an alternative exemplary embodiment.
Figure 20:
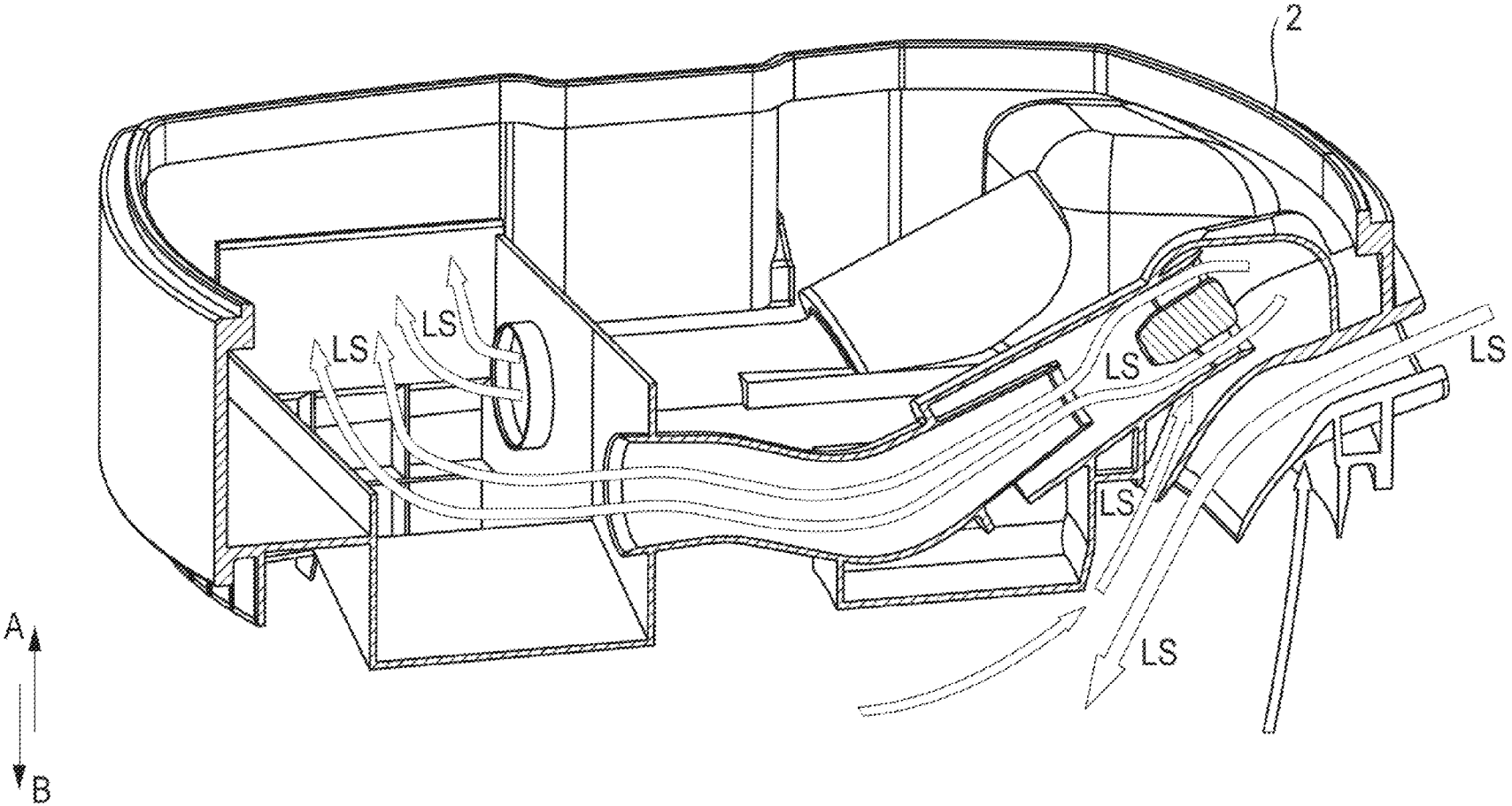
FIG. 20 shows a lateral sectional view through a separating device according to the invention and through a cyclone separator according to the alternative exemplary embodiment.

FIGS. 18 to 20 illustrate the separating device 2 according to the invention according to a second exemplary embodiment. The separating device 2 according to the first exemplary embodiment is substantially identical to the separating device 2 according to the second exemplary embodiment. In contrast to the separating device 2 according to the first exemplary embodiment, in the separating device 2 according to the second exemplary embodiment, the second tube 21*b*, 22*b* of the first and second separator 21, 22 is not configured in a straight manner but in a curved manner. The respectively second tube 21*b*, 22*b* of the first and second separator 21, 22 in this case contains an elbow element KE, which is directed in the arrow direction B. Furthermore, the collection vessels 12, 13 of the separator device 2 according to the second exemplary embodiment do not contain any bottom elements 30*d* configured as nonreturn flaps.

Moreover, the collection vessels 12, 13 contain vertically embodied nonreturn flaps, i.e. nonreturn flaps that extend in the arrow direction A or B, on the long sides 40 of the collection vessels 12, 13.

What is claimed is:

1. A separating device connectable to a vacuum for separating dirt particles from an air stream drawn in by the vacuum, comprising:

at least one separator containing an inlet opening for the air stream and a first outlet opening and second outlet opening, the first outlet opening serving for exit of drawn-in dirt particles from the at least one separator and the second outlet opening serving for exit of a drawn-in air stream and of the drawn-in dirt particles from the at least one separator, the at least one separator including a first tube and a second tube, the first outlet opening being provided in the form of a cutout in a lateral surface of the first tube and at an annular gap between the first and second tube; and a first collection vessel and a second collection vessel for collecting the dirt particles separated from the at least one separator, the first collection vessel positioned in a direction beneath the first outlet opening and the second collection vessel positioned in the direction beneath the second outlet opening;

wherein a bottom element of the first and second collection vessel is configured in the form of a nonreturn flap, such that, as a result of the bottom element configured as a nonreturn flap being opened, the dirt particles collected in the first and second collection vessel can drop out of the first and second collection vessel.

2. A separating device connectable to a vacuum for separating dirt particles from an air stream drawn in by the vacuum, comprising:

at least one separator containing an inlet opening for the air stream and a first outlet opening and second outlet opening, the first outlet opening serving for exit of drawn-in dirt particles from the at least one separator and the second outlet opening serving for exit of a drawn-in air stream and of the drawn-in dirt particles from the at least one separator, the at least one separator including a first tube and a second tube, the first outlet opening being provided in the form of a cutout in a lateral surface of the first tube and at an annular gap between the first and second tube; and a first collection vessel and a second collection vessel for collecting the dirt particles separated from the at least one separator, the first collection vessel positioned in a direction beneath the first outlet opening and the second collection vessel positioned in the direction beneath the second outlet opening;

wherein the at least one separator is configured in the form of an axial separator with the first and the second tube, the second tube releasably positionable at least partly in the first tube.

3. A separating device connectable to a vacuum for separating dirt particles from an air stream drawn in by the vacuum, comprising:

at least one separator containing an inlet opening for the air stream and a first outlet opening and second outlet opening, the first outlet opening serving for exit of drawn-in dirt particles from the at least one separator and the second outlet opening serving for exit of a drawn-in air stream and of the drawn-in dirt particles from the at least one separator, the at least one separator including a first tube and a second tube at least partly inside the first tube, the first outlet opening being provided in the form of a cutout in a lateral surface of the first tube and at an annular gap between the first and second tube; and a first collection vessel and a second collection vessel for collecting the dirt particles separated from the at least one separator, the first collection vessel positioned in a direction beneath the first outlet opening and the second collection vessel positioned in the direction beneath the second outlet opening.

4. The separating device as recited in claim 3 wherein the at least one separator is configured in the form of an axial separator with the first and the second tube, the second tube releasably positioned at least partly in the first tube.

5. The separating device as recited in claim 3 further comprising a frame housing positionable between a suction head and a collecting tank of the vacuum.

6. The separating device as recited in claim 3 wherein the first tube and the second tube define a first separator of the at least one separator, and the at least one separator includes a second separator parallel to the first separator.

7. The separating device as recited in claim 3 wherein the first tube and the second tube define a first separator of the at least one separator, and the at least one separator includes a second separator parallel to the first separator, the first separator being positioned in the first and second collection vessels and the second separator being positioned in third and fourth collection vessels.

8. The separating device as recited in claim 3 wherein each of the first and second collection vessels include bottom elements in the form of non-return flaps.

9. The separating device as recited in claim 3 wherein a bottom element of the first and second collection vessel is configured in the form of a nonreturn flap, such that, as a result of the bottom element configured as a nonreturn flap being opened, the dirt particles collected in the first and second collection vessel can drop out of the first and second collection vessel.

10. The separating device as recited in claim 9 wherein the bottom element is elastically deformable.

11. The separating device as recited in claim 3 wherein the second tube has a cylindrical part and a conical part.

12. The separating device as recited in claim 11 wherein a first and second annular elevation are provided on a second lateral surface of the second cylindrical part, the first annular elevation for releasably fastening the second tube to the first tube.

13. The separating device as recited in claim 12 wherein a free end of the conical part of the first tube enters into a plug connection with the first annular elevation of the second tube.

14. The separating device as recited in claim 12 wherein the second annular elevation of the second tube connected the second tube to the first or second collection vessel.

15. The separating device as recited in claim 3 wherein the first tube has a cylindrical part and a conical part.

16. The separating device as recited in claim 15 further comprising guide vanes in the cylindrical part.

17. The separating device as recited in claim 15 wherein an annular elevation is provided on a lateral surface of the cylindrical part for fastening the first tube to the first or second collection vessel.

18. The separating device as recited in claim 15 wherein the second tube has a second cylindrical part and a second conical part.

19. The separating device as recited in claim 18 wherein a first and second annular elevation are provided on a second lateral surface of the second cylindrical part, the first annular elevation for releasably fastening the second tube to the first tube.

20. The separating device as recited in claim 19 wherein a free end of the conical part of the first tube enters into a plug connection with the first annular elevation of the second tube.

21. The separating device as recited in claim 19 wherein the second annular elevation of the second tube connects the second tube to the first or second collection vessel.

* * * * *